United States Patent [19]

Howell

[11] Patent Number: 4,583,146

[45] Date of Patent: Apr. 15, 1986

[54] FAULT CURRENT INTERRUPTER

[75] Inventor: Edward K. Howell, Simsbury, Conn.

[73] Assignee: General Electric Company, New York, N.Y.

[21] Appl. No.: 665,841

[22] Filed: Oct. 29, 1984

[51] Int. Cl.[4] ..... H01H 9/42

[52] U.S. Cl. ..... 361/13; 361/11

[58] Field of Search ..... 361/11, 13; 338/22 R

[56] References Cited

U.S. PATENT DOCUMENTS 3,249,810 5/1966 Strom et al. ..... 361/11 X 3,962,145 6/1976 Matsuo et al. ..... 338/22 R X

*Primary Examiner*—Harry E. Moose, Jr.

*Attorney, Agent, or Firm*—Richard A. Menelly; Walter C. Bernkopf; Fred Jacob

[57] ABSTRACT

A fault current interrupter is provided by the parallel combination of a positive temperature coefficient resistor and a voltage dependent resistor connected across a pair of separable contacts to permit the interruption of current without the occurrence of arcing between the contacts when the contacts first become separated. The positive temperature coefficient resistor is selected to have a relatively low resistance at room temperature and a substantially higher resistance at higher temperatures. This allows the current to transfer away from the contacts through the positive temperature coefficient resistor until the voltage across the voltage dependent resistor causes the voltage dependent resistor to become conductive and thereby transfer the current away from the positive temperature coefficient resistor.

5 Claims, 3 Drawing Figures

FAULT CURRENT INTERRUPTER

BACKGROUND OF THE INVENTION

U.S. patent application Ser. No. 610,947 filed May 16, 1984 entitled "Solid State Current Limiting Circuit Interrupter" in the name of E. K. Howell discloses the use of semiconductor elements in combination with circuit interrupting contacts to allow the contacts to separate without the occurrence of an arc between the contacts. In the Howell application, which is incorporated herein for purposes of reference, a transistor element is employed in combination with a voltage dependent resistor to transfer the current away from the separating contacts to the transistor and thence from the transistor to the voltage dependent resistor. Some means is required for switching the transistor between conductive and non-conductive states in order for the transistor to be conductive when the contacts are first opened and for the transistor to become non-conductive shortly after contact separation. The Howell application advantageously employs a saturable core current transformer for switching the power transistor on and off within predetermined time intervals. It has since been determined that the same function which the transistor performs can be accomplished by means of a resistor fabricated from a positive temperature coefficient material (PTC) having a relatively low resistance value at low temperatures and a substantially higher resistance at a predetermined higher temperature.

U.S. Pat. Nos. 4,329,726 and 4,413,301 to L. M. Middleman et al. disclose PTC materials operational in the range of 5 to 100 amperes which are employed in series with separable contacts in order to provide circuit protection by the increased series resistance within the circuit when the PTC material carries current higher than a predetermined value.

The use of a material having a negative temperature coefficient within circuit interrupting devices is disclosed within U.S. Pat. No. 4,019,097 entitled "Circuit Breaker With Solid State Passive Overcurrent Sensing Device." This patent teaches the use of a material such as vanadium dioxide or lanthanum cobalt oxide in series with a flux transfer trip mechanism. The thermal response properties of the aforementioned materials are used to sense the presence of an overcurrent condition and to allow the current through a trip mechanism to increase to an operational value. All the aforementioned patents are incorporated herein for purposes of reference. The materials described within the patents to Middleman et al. are incapable of carrying sufficient current to provide overcurrent protection in a circuit such as protected by a molded case circuit breaker.

The purpose of the instant invention is to provide a fault current interrupter employing positive temperature coefficient resistors within circuits capable of interrupting current within residential and industrial power buses without becoming damaged or destroyed in the process.

SUMMARY OF THE INVENTION

Fault current interruption circuits capable of repeatedly interrupting fault currents within certain molded case circuit breaker ratings are made possible by the arrangement of a positive temperature coefficient (PTC) resistor and a voltage dependent resistor (VDR) in parallel with a pair of mechanically switched contacts. Upon separation of the contacts, the current first transfers through the PTC resistor having an initially low resistance. The passage of current through the PTC material rapidly heats the material causing its resistance to increase by several orders of magnitude. The voltage across the PTC resistor and the VDR, in parallel, rapidly increases to the clamping voltage of the VDR, turning on the VDR and transferring the current thereto. Since the voltage across the VDR is substantially higher than supply voltage, the current then rapidly drops to a low value, allowing a pair of auxilliary contacts to complete the interruption process.

DESCRIPTION OF THE PREFERRED EMBODIMENT

Although the use of PTC resistors as series elements in circuit interruption devices is known, the use of such a material as a parallel circuit element for transferring current away from separating contacts to a voltage dependent resistor for eliminating arc occurrence between the contacts has not heretobefore been disclosed.

While various materials may be used in PTC resistors, each providing unique characteristics, the barium titante based ($BaTiO_3$) materials are best known and are suitable for lower current interruption. High current composite metal-insulator materials which undergo a transition from low to high resistance as a function of increasing temperature, are currently under investigation.

Figure 1:
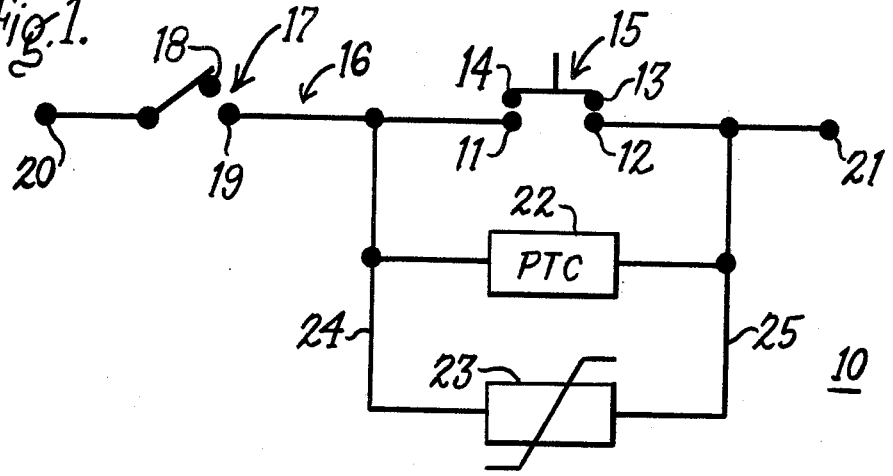
FIG. 1 is a circuit diagram of a circuit interruption arrangement according to the invention.
Figure 3:
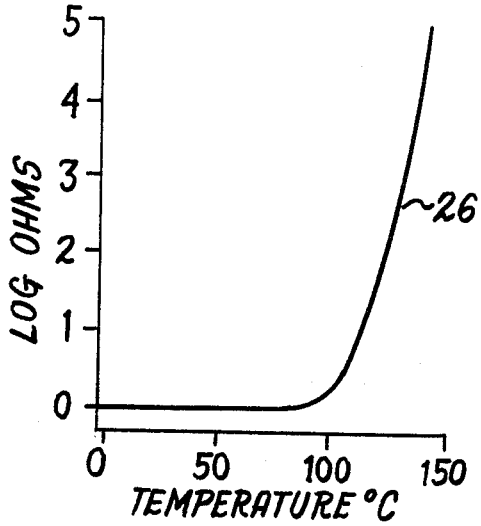
FIG. 3 is a graphic representation of the relationship between the resistance and temperature of the positive temperature coefficient resistor used within FIGS. 1 and 2.

One such fault current interrupter using PTC material is shown in FIG. 1. The fault current interrupter 10 is connected across a main contact assembly 15 consisting of fixed contacts 11, 12 and bridging contacts 13, 14 which are separated upon overload current through a power bus 16. The current through the power bus is sensed by means of a current transformer arranged with its primary winding comprising the power bus and with its secondary winding connected with an operating mechanism to rapidly open the contact assembly 15 when the current reaches a predetermined value. The use of one such current transformer and operating mechanism within a protected circuit is described, for example, in U.S. Pat. No. 4,115,829 to E. K. Howell and U.S. Pat. No. 4,001,742 to C. L. Jencks et al. and reference should be made to these patents for a detailed description. The fault current interrupter 10 provides a function similar to the solid state current limiting circuit interrupter within the aforementioned E. K. Howell application wherein "arcless interruption" occurs between separable contacts by transferring the current away from the contacts via a solid state switch. An auxillary contact assembly 17 having a fixed contact 19 and a movable contact 18 can also be employed in combination with the fault current interrupter 10 if so desired. The power bus 16 is connected to a power source by means of line terminal 20 and to an operating load by means of load terminal 21. A positive temperature coefficient resistor 22, hereafter PTC resistor, is connected in parallel with the separable contact assembly 15 and with a voltage dependent resistor, hereafter VDR, such as a metal oxide varistor 23, hereafter MOV, by means of lines 24 and 25. A typical $BATiO_3$ PTC resistor such as described within the Philips Technical Review publication entitled "PTC Thermistors As Self Regulating Heating Elements" by E. Anrdich has the characteristics depicted at 26 in FIG. 3 wherein the log of the resistance in OHMs is shown to increase suddenly and substantially at a predetermined temperature, in the order of 100° C. to 160° C., for example. In operating the fault current interrupter 10, upon separation of the contact assembly 15, the current immediately transfers through the PTC resistor 22 having a low initial temperature and resistance as indicated by the characteristics described earlier with reference to FIG. 3. The current passes through the PTC resistor causing its temperature and resistance to rapidly increase such that the voltage across the parallel combination of the PTC resistor 22 and the MOV 23 correspondingly increases to the clamping voltage of the MOV causing the current to immediately transfer through the MOV. The voltage, now being substantially higher than the supply voltage, rapidly causes the current through the MOV to drop to a very low value. The MOV can have the composition described within U.S. Pat. No. 4,374,049 in the names of J. Ellis et al. whereby the clamping voltage can be adjusted by varying the composition of the MOV materials as well as the process of fabrication.

The PTC resistor 22 in FIG. 1 is heated by internal power $I^2R$, where R is the resistance of the PTC resistor. When current first transfers to the PTC resistor, R is low, hence the power loss is low and temperature rises slowly. As temperature rises, R increases resulting in higher power loss and faster heating. However, because the power is a function of the square of the current, the heating rate is quite sensitive to current magnitude.

Figure 2:
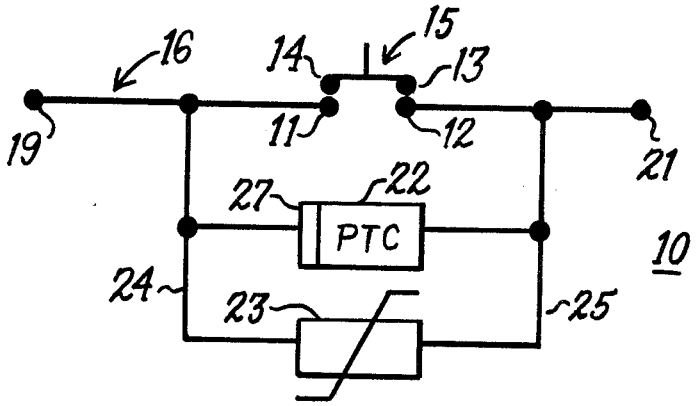
FIG. 2 is a circuit diagram of a further embodiment of the interruption arrangement depicted in FIG. 1.

The fault current interrupter 10 shown in FIG. 2 is similar to that within FIG. 1 wherein the fault current interrupter is connected across a contact assembly 15 within a power bus 16. The PTC resistor 22 is connected in parallel within the contact assembly and with the MOV 23 by means of lines 24, 25. The PTC resistor 22 has a thin layer of MOV material 27 fused to one end which exhibits a very low clamping voltage in the order of approximately 5 volts. When the current transfers from the contact assembly 15 to the PTC resistor 22, the heating power is generated by the product of the voltage across the MOV material 27 and the current through the MOV material. Alternatively, the fixed voltage drop provided by the MOV layer 27 can be distributed in grain boundaries within the material comprising the PTC resistor 22, or in combination with the MOV layer if more rapid heating is desired. Since the initial heating power is a linear function of current, the initial rate of temperature rise in this embodiment is greater and is less sensitive to current magnitude than in the embodiment of FIG. 1.

When high current composite metal-insulator PTC materials are arranged such that the conductive metal is encapsulated within a matrix of MOV material to form a PTC-MOV resistor, the separate MOV 23 is no longer required. The metal would provide initial low temperature and low resistance conductive properties to the PTC-MOV resistor to transfer the current initially away from the contact assembly 15. As the current and temperature increases through the PTC-MOV resistor, the MOV material would expand in volume to interrupt conductive properties of the metal thereby causing the voltage across the PTC-MOV resistor to increase to the clamping voltage of the MOV material. The current upon transfer through the MOV material then rapidly decreases since the MOV clamping voltage is substantially higher than the supply voltage.

Although the fault current interrupter of the instant invention is described for purposes of protecting equipment and wiring within a power bus, this is by way of example only. The fault current interrupter can be used in any situation where "arcless" switching is required such as explosive atmosphere in mines for example, and when "noise-free" switching is required such as with sensitive electronic components within computers.

Having described my invention, what I claim as new and desire to secure by Letters Patent is:

1. A fault current interrupter comprising:

a pair of separable electric contacts arranged for interrupting current flow through an electric circuit; and a positive temperature coefficient resistor electrically connected in parallel across said electric contacts for transferring said current through said positive temperature coefficient resistor when said electric contacts first become separated, said positive temperature coefficient resistor including a layer of material having voltage dependent properties to increase the rate at which said positive temperature coefficient material reached a predetermined temperature.

2. A fault current interrupter comprising:

a pair of separable electric contacts arranged for interrupting current flow through an electric circuit; and a positive temperature coefficient resistor electrically connected in parallel across said electric contacts for transferring said current through said positive temperature coefficient resistor when said electric contacts first become separated, said positive temperature coefficient resistor comprising a material having grain boundaries and wherein said grain boundaries include a material having voltage dependent properties to increase the rate at which said positive temperature coefficient material reaches a predetermined temperature.

3. A fault current interrupter comprising:

a pair of contacts and a resistor connected across said contacts;

said resistor comprising a composite material having a positive temperature coefficient of resistance whereby said resistor exhibits a first resistance at a first temperature and a second higher resistance at a second higher temperature, said material also having voltage dependent properties whereby said resistor exhibits a third resistance at a first voltage drop across said resistor and a fourth lower resistance at a second higher voltage drop across said resistor.

4. The fault current interrupter of claim 3 wherein said positive temperature coefficient resistor and said voltage dependent resistor comprises a composite material whereby said current transfers through one component of said composite material at a first temperature when said electric contacts first becomes separated and then transfers through another component of said composite material at a second temperature higher than said first temperature.

5. The fault current interrupter of claim 3 wherein said composite material comprises a first material having said positive temperature coefficient of resistance and a second material having said voltage dependent properties.

* * * * *